United States Patent [19]

Fuerst et al.

[11] 4,052,159

[45] Oct. 4, 1977

[54] DYEING PROCESS USING QUATERNARY AMMONIUM SALT AS RETARDER

[75] Inventors: Ernst Fuerst; Jozsef Gerendas, both of Neustadt; Rudolf Rokohl; Rolf Fikentscher, both of Ludwigshafen, all of Germany; Herbert Helfert, Trenton, Mich.

[73] Assignee: BASF Aktiengesellschaft, Rhineland-Pfalz, Germany

[21] Appl. No.: 702,956

[22] Filed: July 6, 1976

Related U.S. Application Data

[62] Division of Ser. No. 456,907, April 1, 1974, abandoned.

[30] Foreign Application Priority Data

Apr. 4, 1973 Germany ..... 2316725
Jan. 31, 1974 Germany ..... 2404511

[51] Int. Cl.[2] ..... D06P 5/06

[52] U.S. Cl. ..... 8/169; 8/172 A; 8/172 R; 8/177 AB

[58] Field of Search ..... 8/172, 169, 177 AB

[56] References Cited

U.S. PATENT DOCUMENTS 3,746,709 7/1973 Patton ..... 260/240

*Primary Examiner*—Donald Levy
*Attorney, Agent, or Firm*—Keil, Thompson & Shurtleff

[57] ABSTRACT

Special quaternary ammonium salts derived from triaminoalkyl derivatives of hexahydrotriazine for use as retarders in the dyeing of anionic polyacrylonitrile fibers with basic dyes.

6 Claims, No Drawings

DYEING PROCESS USING QUATERNARY AMMONIUM SALT AS RETARDER

This is a division, of application Ser. No. 456,907, filed Apr. 1, 1974 now abandoned.

This invention relates to quaternary ammonium salts derived from triaminoalkyl derivatives of hexahydrotriazine and to a process for dyeing polyacrylonitrile fibers with basic dyes in the presence of these salts.

When basic dyes are used for dyeing anionic polyacrylonitrile fibers or polymer fibers containing acrylonitrile which contain acid groups from a long liquor the dyeings obtained are not level if differences in temperature and concentration exist in the dyeing apparatus. Even very slight differences have this effect because the rate of absorption of cationic dyes is extremely sensitive to temperature. Various methods have hitherto been put forward to overcome this risk of unlevel dyeings. These include:

1. Extremely slow heating up of the dye liquor. This has obvious disadvantages; it is uneconomic because of the time wasted; it is also unreliable.

2. Control of the dyeing process by previously calculating a temperature at which the textile material is to be dyed at a definite rate of liquor exhaustion (German Printed Application (DAS) No. 1,619,376). This method is expensive and requires specially trained personnel.

3. The use of levelling agents which increase the levelling effect and yet have only slight influence on the absorptivity of the dye (German Pat. No. 1,148,971). The levelling agents are quaternary ammonium compounds having no fatty alkyl radicals. These have the disadvantage that they have little effect in the case of pale shades.

4. The use of a substance known as a retarder which decreases the rate of dyeing. These are quaternary ammonium salts containing at least one fatty alkyl radical of from eight to twenty-two carbon atoms (German Printed Applications (DAS) Nos. 1,090,171, 1,092,878 and 1,643,526). Prior art retarders of this type are not entirely satisfactory in their effectiveness.

The invention has for its object to provide retarders which obviate the disadvantages of known retarders.

We have found that this object is achieved by a salt containing quaternary ammonium groups and having the formula (I):

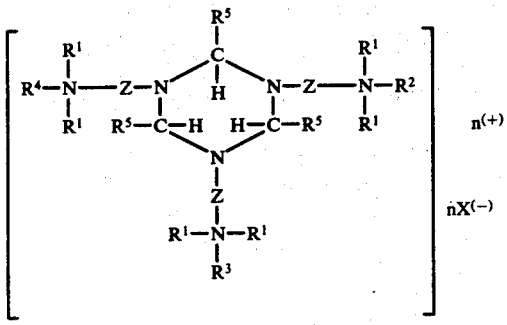

in which the various radicals $R^1$ may be independently of one another a linear or branched unsubstituted or hydroxyl-substituted alkyl of one to six carbon atoms; or two radicals $R^1$ joined to a common nitrogen atom may form together with the same a heterocycle of four to seven carbon atoms, $R^2$, $R^3$ and $R^4$ independently of one another may each be cyclic, linear or branched saturated or olefinically unsaturated substituted or hydroxyl-substituted alkyl of one to thirty carbon atoms which may be interrupted by ether bridges, an unsubstituted, chloro-substituted or alkyl-substituted phenyl or benzyl group of one to twelve carbon atoms in the alkyl moieties, and $R^3$ and $R^4$ may also be hydrogen or a free electron pair, $R^5$ is hydrogenor alkyl of one to four carbon atoms, Z is unsubstituted or particularly hydroxyl-substituted alkylene of two to six carbon atoms which may be interrupted by ether or ester groups, $X^{(-)}$ is an organic or inorganic anion which when there is more than one may be of different natures, and *n* is an integer of from 1 to 3.

These compounds may be prepared by reacting a hexahydrotriazine of the general formula (II):

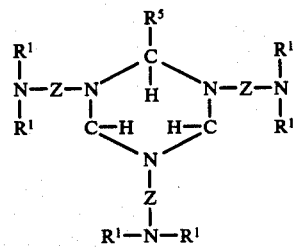

in which $R^1$, $R^5$ and Z have the above meanings in the absence or presence of a polar high boiling point liquid, for example dimethylformamide, with a conventional quaternizing agent such as dimethyl sulfate, diethyl sulfate, methyl chloride, benzyl chloride, lauryl chloride or stearyl chloride or an alkylene oxide in the presence of an acid at from 20° to 150° C and thus converting it into the monoquaternary, bisquaternary or trisquaternary salt by appropriate choice of the molar proportions; when a molar ratio of less than 1:3 is used mixtures of the various quaternary salts may be formed and in some cases some triazine may remain unconverted.

Mixtures are also obtained when different quaternizing agents are used simultaneously or consecutively.

It is particularly advantageous for the resulting quaternary salts (I) whose aqueous solutions are generally turbid to a greater or lesser degree depending on the alklyating agent and the degree of alkylation to be made neutral or weakly acid by adding an acid, preferably a weak acid which is easily available in industry, as for example formic acid, so that a clear solution is obtained which can be diluted well. The anions of these acids are represented in formula (I), as the anions of the quaternizing agents are also represented as $X^{(-)}$.

The production of the 1,3,5-tris-(Ω-dialkylaminoalkyl)-hexahydrotriazines of formula (II) may be carried out by known methods by reaction of an asymmetrically dialkylated alkylenediamine with an equimolar amount of an aliphatic aldehyde.

$R^1$ in the formulae (I) and (II) contains from one to six and preferably from one to four carbon atoms. $R^2$, $R^3$ and $R^4$ in formula (I) contain from one to thirty and preferably from ten to eighteen carbon atoms. Preferred anions $X^{(-)}$ are bromide ions and particularly chloride, ethosulfate and methosulfate anions ($ROSO_3^{(-)}$ where R is $C_2H_5$ or $CH_3$). In principle however any anion of an alkylating agent is suitable.

Conventional additions to the dye liquor, for example salts such as sodium sulfate, chloride or acetate or acids such as acetic acid or buffer solutions may be present in dyeings with basic dyes in addition to the quaternary ammonium compounds to be used according to the invention.

The quaternary ammonium compounds to be used may be employed in the form of pure compounds or as commercial mixtures. Similarly they may be used alone or in combination with appropriate surface-active compounds, as for example the surface-active adducts of ethylene oxide to fatty amines, fatty alcohols or alkylphenols. The amount of quaternary compound to be used has to be adjusted in accordance with the tinctorial conditions obtaining, for example according to the type and amount of basic dye and according to the character and processing condition of the fibrous material to be dyed. It is from 0.003 to 1.5% and preferably from 0.04 to 0.4% of the weight of the material and may be added to the dye liquor prior to use or in the course of the dyeing. It is also possible to pretreat the fibrous material with the quaternary compound. The fibrous material to be dyed may be in any form, for example as loose fibers, as yarn or as cloth.

Anionic polyacrylonitrile fibers include fibers of polyacrylonitrile and particularly acrylonitrile copolymers containing at least 50% and preferably from 80 to 98% by weight of acrylonitrile units which (with or without conventional comonomers such as acrylamide, acrylic esters, methacrylic esters, vinyl esters, vinyl chloride and the like) contain comonomers having anionic groups, for example olefinically unsaturated carboxylic acids such as acrylic acid, methacrylic acid or also olefinically unsaturated sulfonic acids.

In some cases the content of carboxyl groups in the polyacrylonitrile formed by hydrolysis of a small portion of the nitrile groups is sufficient.

Examples of basic dyes are dyes of the diarylmethane, triarylmethane, indolylarylmethane, diindolylarylmethane, oxazine, thiazine, diazine, thiazole, xanthene, acridine, quinoline, quinophthalone, indoline and cyanine dyes and also the basic azo and azomethine dyes. The dyes are described for example in the "American Dyestuff Reporter" (1954), pages 432 to 433 and also in U.S. Pat. No. 2,716,655 and British Pat. No. 785,988 or 791,932 (which literature is hereby incorporated by reference).

The compounds of the invention have the following advantages over prior art retarders for dyeing polyacrylonitrile fibers:

1. Considerably smaller amounts have to be used to achieve the same levelness as is obtained with retarders hitherto used because of the higher effectiveness.

2. Because of the low concentration of cation-active levelling agent which has to be used there is no risk of fiber blocking, i.e. there is no fear that dye subsequently added for example for shading will not be absorbed by the fiber within the conventional dyeing period. This risk is present in the case of prior art retarder types such as lauryl dimethyl benzyl ammonium chloride.

The following Examples illustrate the invention. Percentages in the following Examples relate to the weight of the material to be dyed. Parts are parts by weight.

EXAMPLE 1

1,3,5-tris-(3-dimethylaminopropyl)-hexahydrotriazine (III)

306 parts of N,N-dimethylaminopropylamine is dripped at 15° to 35° C in thirty-five minutes into 240 parts of a 37.5% aqueous formaldehyde solution while stirring and cooling with a waterbath. The whole is then stirred for another thirty miuntes. The water is distilled off at a bottoms temperature of from 52° to 120° C and 100 mm. High vacuum distillation of the residue gives 300 parts of (III) which is 87.8% of theory. The boiling point at 1 mm is 155° to 159° C. The product is a water-clear liquid, $n_D^{25}$: 1,4757.

EXAMPLE 2

(III) + lauryl chloride (molar ratio: 1:1)

53.3 parts of lauryl chloride and
85.5 parts of (III)
are quantitatively reacted in six hours at 140° C under an atmosphere of nitrogen.

The golden yellow product (which is the retarder) dissolves in water to give a cloudy solution which becomes clear upon acidification.

INSTRUCTIONS FOR DYEING 10 parts of anionically modified polyacrylonitrile high-bulk yarn is dyed at a constant temperature of 95° C in 600 parts of dye liquor which contains 0.25% based on the yarn of the cationic dye of the formula:

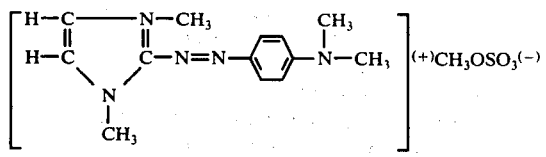

0.1 part of glacial acetic acid, 0.02 part of sodium acetate and variable amounts of retarder. A number of experiments is carried out to determine the amount of retarder which prolongs the absorption time of the dye under the said conditions to sixty minutes. Absorption time is defined as the time within which the dye is absorbed to the extent of 98%. The amount of dye remaining in the dye liquor is determined colorimetrically.

In the present case (Example 2) this amount of retarder is 0.12 part.

EXAMPLE 3

(III) + ;auryl chloride (1:2)

128 parts of (III) and
159.5 parts of lauryl chloride
are converted quantitatively into the bisquaternary salt in ten hours at 130° C under a nitrogen atmosphere.

The pale yellow solid substance dissolves in water to give a turbid solution which becomes clear upon acidification.

In dyeing carried out in accordance with the instructions in Example 2 the amount of retarder determined is 0.06 part.

EXAMPLE 4

(III) + lauryl chloride (1:1.1)

85.5 parts of (III) and
80 parts of lauryl chloride
are quantitatively reacted in six hours at 135° C under a nitrogen atmosphere.

The retarder thus obtained behaves like those in the two preceding Examples when dissolved in water.

In dyeing according to the directions in Example 2 the amount of retarder required is 0.08 part.

EXAMPLE 5

(III) + lauryl chloride (1:2.8)

7.9 parts of (III) and
83.5 parts of lauryl chloride
are converted to the extent of about 99% into the quaternary salt in ten hours at 150° C under a nitrogen atmosphere.

The solid yellow salt obtained dissolves in water to give a cloudy solution which becomes clear when acidified.

0.06 part of this retarder is required according to the dyeing instructions of Example 2.

EXAMPLE 6

(III) + octadecyl chloride (1:1)

239.4 parts of (III) and
202 parts of octadecyl chloride are practically quantitatively reacted in six hours at 150° C under a nitrogen atmosphere.

The yellow semisolid substance dissolves in water to give a turbid solution which becomes clear when it is acidified.

0.14 part of retarder is required according to the instructions of Example 2.

EXAMPLE 7

30.24 parts of dimethyl sulfate is dripped at 50° C within ten minutes into 75.7 parts of the quaternary salt from Example 6 dissolved in 35 parts of propanol and then the whole is stirred for another thirty minutes at 50° C.

The resulting viscous yellow trisquaternary salt dissolves in water to give a clear solution.

0.15 part of the salt is required according to the instructions of Examples 2.

EXAMPLES 8

18.9 parts of dimethyl sulfate is cripped within five minutes at 50° C into 47 parts of the quaternary salt from Example 4 dissolved in 23 parts of isopropanol and the whole is then stirred for another 30 minutes at 50° C.

The viscous reddish liquid dissolves in water to give a clear solution.

0.1 part of this retarder is required in dyeing according to Example 2.

EXAMPLE 9

342 parts of (III) is reacted with 804 parts of octadecyl chloride while stirring in a nitrogen atmosphere at 140° C, the octadecyl chloride being added in three equal portions of 268 parts each at intervals of one hour. After the final addition the whole is stirred for from about eight to ten hours at 140° C until titration of the chlorine number indicates complete reaction.

The quaternary salt is a solid yellow product at ambient temperature; it has good solubility in water.

0.08 part of the product is neede according to the instructions of Example 2.

EXAMPLE 10

775 parts of lauryl chloride is added in three equal portions of 258 parts at intervals of fifty minutes to 600 parts of 1,3,5-(2 -dimethylaminoethyl)-hexahydrotriazine while stirring in a nitrogen atmosphere at 135° C. As soon as titration of the ionic chlorine number indicates the end of the reaction the temperature is first lowered to 115° to 120° C and a total of 504 parts of dimethyl sulfate is dripped in within one hour. The whole is stirred at the said temperature until quaternization is over. The reaction product is a pale yellowish brown paste which dissolves easily in water.

0.2 part of the paste is required according to the instructions of Example 2.

EXAMPLE 11

100 parts of polyacrylonitrile fibers are dyed at a constant temperature of 95° C in 4000 parts of dye liquor containing 0.12% based on the weight of fiber of the dye C.I. No. 11,460, 1% of glacial acetic acid and 0.5% of sodium acetate.

Without the addition of retarder the dye liquor is exhausted within ten minutes and the skein of yarn is dyed unlevel. When 0.3 part of the retarder prepared according to Example 9 is added the dye liquor after fifty minutes still contains 15% and after sixty minutes 5% of the amount of dye originally added. The dyeing is level as may be proved by knitted goods prepared from the yarns which show no difference whatever in depth of color.

0.9% by weight based on the weight of fiber of tridecyltrimethyl ammonium chloride (prior art) has to be used to achieve the same delay in the absorption of the dye.

EXAMPLE 12

50 parts of machine knitting yarn (metric number 2/40) of a copolymer from 90% of acrylonitrile and 10% of vinyl acetate is dyed in skein form in a yarn dyeing apparatus of the two-stick suspension system with propeller circulation at a liquor ratio of 35:1 with 0.4% based on the weight of fiber of the blue dye of the formula:

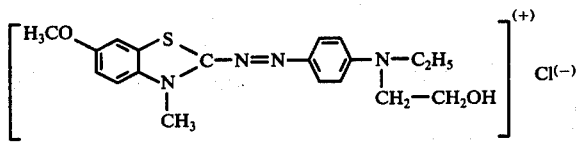

with the addition of 2 parts by volume of sulfuric acid (96%) and 10 parts of sodium sulfate. The temperature of the dye liquor at the beginning is 75° C; it is raised within thirty minutes to 90° C and from 90° C the temperature of the liquor is raised 2° C every ten minutes of the dyeing period up to the boiling temperature and then kept for another hour at this temperature. The dyeing achieved in this way is markedly unlevel because the dye is absorbed spontaneouly at from 94° to 98° C. A level dyeing is obtained however when dyeing is carried out under otherwise the same conditions but with the addition of 0.050 part (=0.1%) of the retarder obtained according to Example 10. When the amount of retarder is increased to 0.1 part (=0.2%) it is possible to shorten the dyeing time and to raise the temperature from 90° to 100° C within ten minutes by 5° C and then to contiune heating for only 30 minutes. The dyeing is level. In order to obtain the same effect with the bisquaternary ammonium compound according to Example 3 of German Printed Specification (DAS) No. 1,092,878 it is necessary to use 0.1 to 0.125 part (with increase in temperature from 90° to 100° C by 1° C within five minutes) or 0.2 to 0.25 part (with a rise in temperature from 90° to 100° C by 1° C within 2½ minutes).

A similar levelling effect as with the retarder according to Example 10 is obtained when the same amount of the reaction product from 1 mole of 1,3,5-tris-(dimethylaminoethyl)-hexahydrotriazine + 2 moles of cetyl chloride or 1.5 moles of cetyl chloride +0.7 mole of lauryl chloride +1 mole of ethyl bromide is used.

EXAMPLES 13 to 16

342 parts of hexahydrotriazine (III) is mixed with *a* parts of an alkyl chloride (A) and *b* parts of dimethylformamide and heated for *c* hours at 130° C. The solution obtained has a chloride number *d* (in %) and the properties *e*. Dimethylformamide may be replaced for example by dimethylsulfoxide or hexamethylphosphorio acid triamide. The retarder in each case is used as a solution according to the instructions of Example 2. Column *f* gives the amount (in % by weight based on the fibrous material) of active substance (solids content of the solutions) which delays the absorption of the dye to one hour.

OC = octyl chloride; LC = lauryl chloride.

| Ex. | a | A | b | c | d | e | f |
|---|---|---|---|---|---|---|---|
| 13 | 416 | OC | 758 | 5 | 6.58 | pale yellow; soluble in water | 0.05 |
| 14 | 256 | LC | 598 | 5 | 3.58 | yellowish orange; soluble in water | 0.055 |
| 15 | 383 | LC | 725 | 3 | 4.33 | yellowish orange; soluble in water | 0.06 |
| 16 | 618 | LC | 960 | 7.5 | 5.33 | yellowish orange; dilutable with water to a slightly cloudy solution | 0.067 |

0.3% of retarder is necessary when the bisquaternary salt of the formula

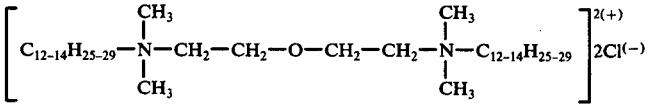

(cf. German Printed Application (DAS) No. 1,092,878) is used as retarder according to the instructions of Example 2.

When no retarder is added the dye liquor is as a rule exhausted within ten minutes and the dyeing is unlevel.

EXAMPLE 17

(III) and benzyl chloride (1:2.8)

171 parts of 1,3,5-tris-(3-dimethylaminopropyl)-hexahydrotriazine (III) is dissolved in 348 parts of dimethylformamide. 177 parts of benzyl chloride is dripped in at 120° C under nitrogen while stirring and the whole is further stirred for five hours at 120° to 130° C. The solution of the quaternary salt in dimethylformamide formed is pale brown in color.

Analysis: $Cl^{(-)}$: 7.0% (theory 7.13%).

The retarding effect is tested as follows:

DYEING INSTRUCTIONS 10 parts of anionically modified polyacrylonitrile high-bulk yarn is introduced into 600 parts of a dye liquor which is heated to 85° C and which contains 0.02 part of the cationic dye of the formula:

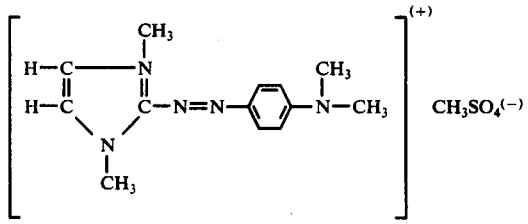

0.1 part of glacial acetic acid, 0.02 part of sodium acetate and variable amounts of retarder. The temperature of the dye liquor is raised to boiling point at a rate of heating up of 0.33° C per minute. The amount of retarder required for the dye to be absorbed onto the fiber to the extent of 98% in fifty minutes is ascertained. The dye without retarder is absorbed onto the fibers within twenty minutes.

The amount of retarder required in this Example is 0.008 part.

The retarder of the formula:

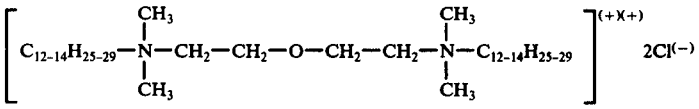

described in German Patent 1,092,878 serves for comparison. The amount of this compound (which is considered to be particularly effective) required according to the instructions given in Example 17 is 0.022 part.

EXAMPLE 18

(III) and o-chlorobenzyl chloride (1:2.8)

171 parts of (III) is dissolved in 396 parts of dimethylformamide and reacted with 225 parts of o-chlorobenzyl chloride as described in Example 17. The solution of the quaternary salt formed in dimethylformamide is clear and has a pale brown color.

Analysis: $Cl^{(-)}$: 6.22% (theory: 6.28%).

The amount of this compound required according to the instructions of Example 17 is 0.004 part.

EXAMPLE 19

(III) and p-chlorobenzyl chloride (1:2.8)

171 parts of (III) is dissolved in 396 parts of dimethylformamide and reacted analogously to Example 17 with 225 parts of p-chlorobenzyl chloride. The solution of the reaction product in dimethylformamide has a pale brownish color and is clear. Analysis of the reaction product: $Cl^{(-)}$: 6.18% (theory: 6.28%).

The amount of this compound required according to the instructions in Example 17 is 0.004 part.

EXAMPLE 20

(III) and 3,4-dichlorobenzyl chloride (1:2.8)

171 parts of (III) is dissolved in 445 parts of dimethylformamide and reacted analogously to Example 1 with 274 parts of 3,4-dichlorobenzyl chloride. The solution of the reaction product is dimethylformamide is clear and has a pale brown color. Analysis of the reaction product: $Cl^{(-)}$: 5.50% (theory: 5.58%).

The amount of the compound required according to the instructions in Example 17 is 0.004 part.

EXAMPLE 21

(III) and n-decyl-2-chloroethyl ether (1:2.8)

342 parts of (III) is dissolved in 1238 parts of dimethylformamide. 896 parts of n-decyl-2-chloroethyl ether is dripped in at 130° C under nitrogen while stirring and the whole is stirred for eight hours at 130° C. The solution of the reaction product is dimethylformamide is cloudy and has a slight brownish color.

0.004 part of the product formed is required according to the instructions in Example 17.

EXAMPLE 22

342 parts of (III) is dissolved in 1558 parts of dimethylformamide. 896 parts of n-decyl-2-chloroethyl-(1) ether is dripped at 130° C into the solution under nitrogen while stirring and the whole is stirred for another eight hours at 130° C. The whole is then allowed to cool and quaternization is carried out at this temperature for another three hours with 320 parts of dimethyl sulfate. The solution of the reaction product in dimethylformamide has a pale brown color and is clear.

The amount of the product formed required according to the instructions in Example 17 is 0.005 part.

We claim:

1. In a process for dyeing an anionic polyacrylonitrile fibrous material with a basic dye in the presence of a retarder, the improvement which comprises using as the retarder in said dyeing process a salt containing quaternary ammonium groups and having the formula

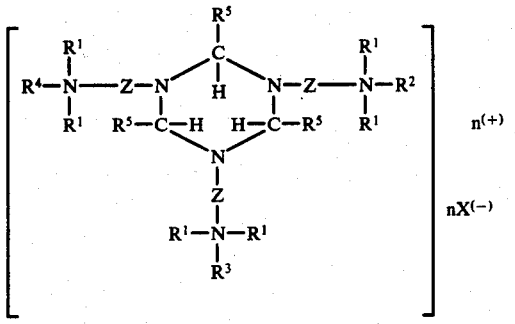

in which each radical $R^1$ is a linear or branched and unsubstituted or hydroxyl-substituted alkyl of one to six carbon atoms or in which two radicals $R^1$ joined to a common nitrogen atom form therewith a heterocylic radical of four to seven carbon atoms; $R^2$, $R^3$ and $R^4$, respectively, are a cyclic, linear or branched, saturated or olefinically unsaturated and unsubstituted or hydroxyl-substituted alkyl of one to 30 carbon atoms or said alkyl is interrupted by one or more ether bridges, or an unsubstituted, chloro-substituted or alkyl-substitute phenyl or benzyl group of one to twelve carbon atoms in the alkyl substituents, and $R^3$ and $R^4$ may also be hydrogen or a free electron pair; $R^5$ is hydrogen or alkyl of one to four carbon atoms; Z is an unsubstituted or hydroxyl-substituted alkylene of two to six carbon atoms or said alkylene radical which is interrupted by ether groups; $X^{(-)}$ is the organic or inorganic anion of an alkylating agent; and *n* is a number of from 1 to 3.

2. A process as claimed in claim 1 in which said salt is used as the retarder in an amount of from 0.003 to 1.5% based on the weight of said fibrous material.

3. A process as claimed in claim 1 wherein the retarder salt of the given structural formula is one in which $R^2$, $R^3$ and $R^4$ each represent hydrogen or lauryl, at least one being lauryl, and the anion X is a chloride ion.

4. A process as claimed in claim 3 wherein the retarder salt of the given structural formula is one in which Z is propyl, $R^1$ is methyl and $R^5$ is hydrogen.

5. A process as claimed in claim 1 wherein the retarder salt of the given structural formula is one in which $R^2$, $R^3$ and $R^4$ each represent hydrogen or octyl, at least one being octyl, and the anion X is a chloride ion.

6. A process as claimed in claim 5 wherein the retarder salt of the given structural formula is one in which Z is propyl, $R^1$ is methyl and $R^5$ is hydrogen.

* * * * *